US008844314B2

(12) United States Patent
Bortoletto et al.

(10) Patent No.: US 8,844,314 B2
(45) Date of Patent: Sep. 30, 2014

(54) CLEAR ICE MAKING SYSTEM AND METHOD

(75) Inventors: Anderson Bortoletto, Waunakee, WI (US); Rogerio Soares Brisola, Joinville (BR); Douglas D. Leclear, Benton Harbor, MI (US); James Peterson, Stevensville, MI (US); Fabio E. Rosa, Joinville (BR); Vanessa Christina Riberio, Joinville (BR); Simone M. Vidal, Curitiba (BR); Ronald L. Voglewede, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 501 days.

(21) Appl. No.: 13/166,102

(22) Filed: Jun. 22, 2011

(65) Prior Publication Data

US 2012/0324916 A1 Dec. 27, 2012

(51) Int. Cl.

| | |
|---|---|
| ***F25C 1/00*** | (2006.01) |
| ***F25C 1/18*** | (2006.01) |
| ***F25C 1/08*** | (2006.01) |

(52) U.S. Cl.

CPC ..... *F25C 1/08* (2013.01); *F25C 2400/10* (2013.01); *F25C 1/18* (2013.01); *F25C 2305/022* (2013.01); *F25C 2400/14* (2013.01)

USPC ..... 62/353; 62/348; 62/347

(58) Field of Classification Search

USPC ..... 62/347–348, 353, 68, 342, 66–67, 71, 62/74

See application file for complete search history.

(56) References Cited

U.S. PATENT DOCUMENTS

| | | | | |
|---|---|---|---|---|
| 1,825,698 | A | | 10/1931 | King |
| 2,349,367 | A | | 5/1944 | Muffly |
| 3,045,440 | A | * | 7/1962 | McGrath et al. ..... 62/68 |
| 3,380,261 | A | | 4/1968 | Hendrix et al. |
| 3,418,823 | A | | 12/1968 | Salimbeni Vivai |
| 3,433,030 | A | | 3/1969 | Jacobs |
| 3,526,100 | A | * | 9/1970 | Briel ..... 62/136 |
| 3,812,686 | A | * | 5/1974 | Tester ..... 62/180 |
| 4,184,339 | A | | 1/1980 | Wessa |
| 4,199,956 | A | | 4/1980 | Lunde |
| 4,207,750 | A | | 6/1980 | Simkens |
| 4,896,800 | A | | 1/1990 | Corey |

(Continued)

FOREIGN PATENT DOCUMENTS

| | | |
|---|---|---|
| EP | 0227611 A1 | 7/1987 |
| EP | 0580950 A1 | 2/1994 |

(Continued)

*Primary Examiner* — Cassey D Bauer
*Assistant Examiner* — Steve Tanenbaum

(57) ABSTRACT

A clear ice making system and method utilizes an ice tray including a plurality of ice forming cavities extending into a fluid supply cavity. Fluid supplied to the fluid supply cavity flows into each of the plurality of ice forming cavities and out through respective fluid outlets located in a bottom portion of the ice forming cavities to a fluid outlet chamber below. Cooled ice forming members extend into respective ice forming cavities. Fluid is continuously cycled through the ice forming cavities and around the ice forming members during an ice making event such that clear ice pieces gradually form on each of the ice forming members. During an ice harvest event, ice forming members are heated to release formed ice pieces, and the ice pieces are transferred from a fresh food compartment of a refrigerator to an ice storage bucket located in a freezer compartment of the refrigerator.

20 Claims, 4 Drawing Sheets

(56) References Cited

U.S. PATENT DOCUMENTS

| | | | | |
|---|---|---|---|---|
| 5,032,157 | A | 7/1991 | Ruff | |
| 5,127,236 | A | 7/1992 | Von Blanquet | |
| 5,187,948 | A | 2/1993 | Frohbieter | |
| 5,207,761 | A | 5/1993 | Ruff | |
| 5,212,957 | A * | 5/1993 | Ruff | 62/124 |
| 5,272,884 | A | 12/1993 | Cur et al. | |
| 5,297,394 | A | 3/1994 | Frohbieter et al. | |
| 5,375,432 | A | 12/1994 | Cur | |
| 5,425,243 | A | 6/1995 | Sanuki et al. | |
| 5,987,900 | A | 11/1999 | Love | |
| 6,000,228 | A | 12/1999 | Johnson et al. | |
| 6,647,739 | B1 | 11/2003 | Kim et al. | |
| 6,688,130 | B1 * | 2/2004 | Kim | 62/352 |
| 6,688,131 | B1 | 2/2004 | Kim et al. | |
| 6,742,351 | B2 | 6/2004 | Kim et al. | |
| 6,907,744 | B2 | 6/2005 | Miller et al. | |
| 6,952,937 | B2 * | 10/2005 | Choi et al. | 62/347 |
| 7,062,936 | B2 | 6/2006 | Rand et al. | |
| 7,082,782 | B2 | 8/2006 | Schlosser et al. | |
| 7,587,905 | B2 | 9/2009 | Kopf | |
| 7,617,693 | B2 * | 11/2009 | Lee | 62/135 |
| 7,841,198 | B2 * | 11/2010 | Bippus et al. | 62/233 |
| 2004/0255606 | A1 | 12/2004 | Hornung | |
| 2008/0156000 | A1 * | 7/2008 | Shin et al. | 62/73 |
| 2009/0211266 | A1 | 8/2009 | Kim et al. | |
| 2009/0260371 | A1 | 10/2009 | Kuehl et al. | |
| 2009/0293508 | A1 | 12/2009 | Rafalovich et al. | |
| 2010/0218518 | A1 | 9/2010 | Ducharme et al. | |

FOREIGN PATENT DOCUMENTS

| | | | |
|---|---|---|---|
| EP | 0580952 | A1 | 2/1994 |
| EP | 0736738 | A2 | 10/1996 |
| GB | 2189016 | A | 10/1987 |
| JP | H08193773 | A * | 7/1996 |
| JP | 2002206826 | A * | 7/2002 |

* cited by examiner

CLEAR ICE MAKING SYSTEM AND METHOD

BACKGROUND OF THE INVENTION

1. Field of the Invention

The present invention pertains to the art of ice making and, more particularly, to icemakers which produce clear ice pieces.

2. Description of the Related Art

In general, ice pieces produced with standard icemakers tend to include air bubbles or other imperfections that lend a cloudy or impure appearance to the ice. Therefore, there has been an interest in constructing icemakers which produce clear ice pieces. One approach to preventing the formation of cloudy ice is by agitating or moving water in an ice try during the freezing process. For example, U.S. Pat. No. 4,199,956 teaches an ice making method wherein a plurality of freezing elements are immersed in a pan of water which is agitated by a plurality of paddles during a freezing process. However, this type of icemaker requires multiple moving parts which make production and maintenance of the icemaker more costly.

Additionally, it is known in the art to produce ice cubes by freezing water about the periphery of evaporator fingers. For example, U.S. Patent Application Publication No. 2010/0218518 feeds water to a first cavity of a multi-cavity mold, where it cascades into the next cavity until all the cavities are full. Fingers of an evaporator are located in the respective cavities, and ice pieces form on the fingers. The fingers are heated in order to release the formed ice pieces from the fingers and drop the ice into a container below. However, such systems do not provide the advantages of the clear icemakers discussed above. A similar system is also depicted in U.S. Pat. No. 6,742,351, which includes a cam motor that periodically rocks water freezing cells to remove air bubbles on the surface of evaporator fingers. Although this system improves ice quality by removing air bubbles on the surface of the evaporator fingers, there continues to be a need for alternative icemakers that provide improved ice quality and clarity using minimal moving parts.

SUMMARY OF THE INVENTION

The present invention is directed to a clear ice making system and method for use in a refrigerator. The clear ice making system utilizes an ice tray including a plurality of ice forming cavities spaced within a fluid supply cavity. Water supplied to the fluid supply cavity flows into each of the plurality of ice forming cavities and out through respective fluid outlets located in a bottom portion of the ice forming cavities to an outlet cavity below. The clear ice making system also includes an evaporator plate arranged in contact with an evaporator forming part of a refrigerant circulation system of the refrigerator. During an ice making event, a plurality of chilled ice forming fingers extending from the evaporator plate are inserted into the plurality of ice forming cavities. Fluid is continuously cycled through the ice forming cavities and around the ice forming members during an ice making event such that clear ice pieces gradually form on each of the ice forming members. During an ice harvest event, the ice forming members are heated to release formed ice pieces. In accordance with the preferred embodiment of the invention, the icemaker is located in a fresh food compartment of the refrigerator and the formed ice pieces are transferred from the fresh food compartment to an ice storage bucket located in a freezer compartment of the refrigerator.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
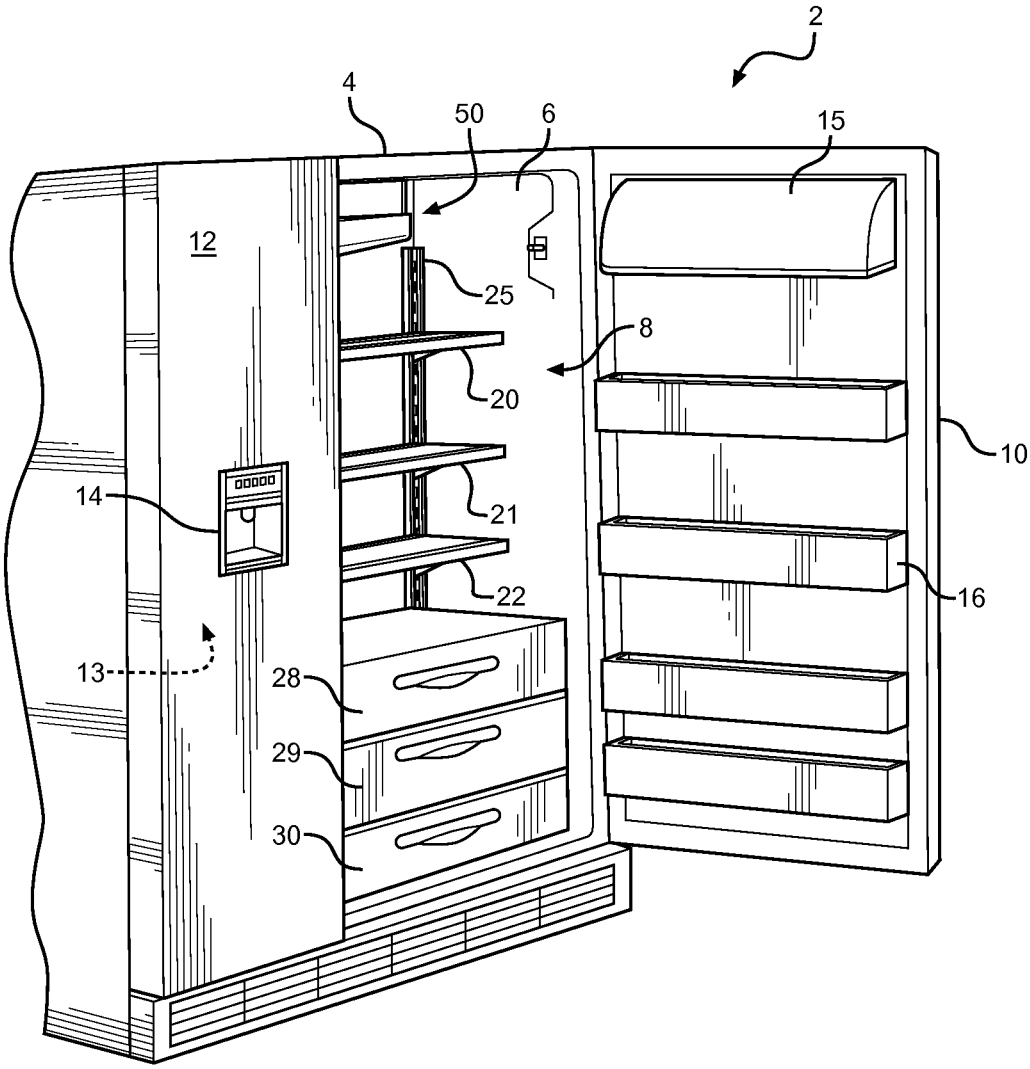
FIG. 1 is a perspective view of a refrigerator including an icemaker system of the present invention.

With initial reference to FIG. 1, a refrigerator 2 includes an outer shell or cabinet 4 within which is positioned a liner 6 that defines a fresh food compartment 8. In a manner known in the art, fresh food compartment 8 can be accessed by the selective opening of a fresh food door 10. In a similar manner, a freezer door 12 can be opened to access a freezer compartment 13. In the embodiment shown, freezer door 12 includes a dispenser 14 that enables a consumer to retrieve ice and/or fresh water without accessing fresh food or freezer compartments 8 and 13. For the sake of completeness, door 10 of refrigerator 2 is shown to include a dairy compartment 15 and various vertically adjustable shelving units, one of which is indicated at 16.

In a manner known in the art, fresh food compartment 8 is provided with a plurality of vertically, height adjustable shelves 20-22 supported by a pair of shelf support rails, one of which is indicated at 25. At a lowermost portion of fresh food compartment 8 is illustrated various temperature controlled bins 28 and 29, as well as a more conventional storage compartment 30. The above described refrigerator structure is known in the art and presented only for the sake of completeness. The present invention is particularly directed to a clear ice making system which is generally indicated at 50.

Figure 2:
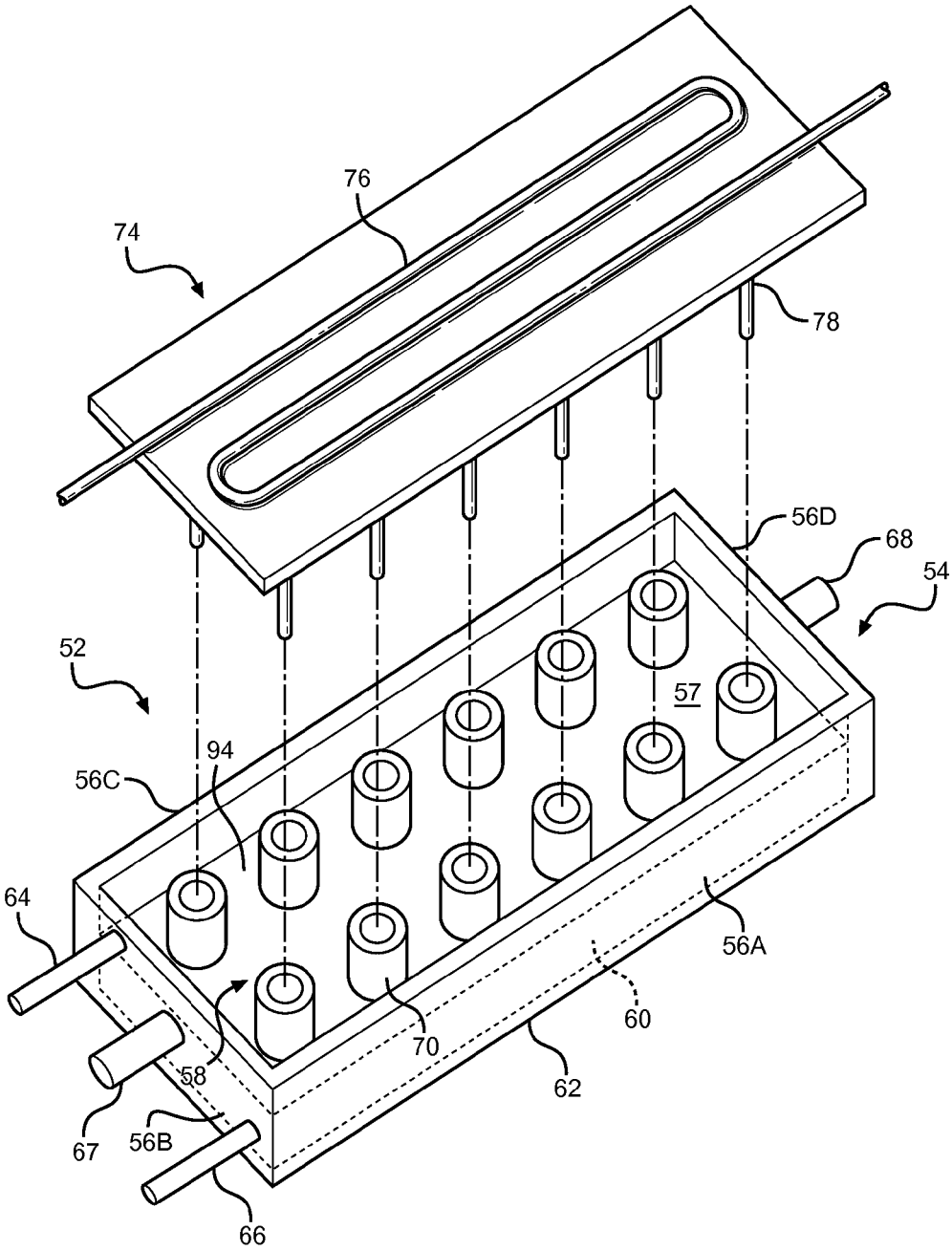
FIG. 2 is a perspective view of an icemaker system of the present invention.

Details of an icemaker 52 utilized in clear ice making system 50 will now be discussed with reference to FIG. 2. Icemaker 52 includes a housing or ice tray 54 defined by a plurality of upstanding side walls 56A-56D and a cavity floor 57 defining a fluid supply cavity 58. A fluid outlet chamber 60 is positioned below fluid supply cavity 58 and defined by side walls 56A-56D and a bottom wall 62. A fluid supply line 64 is in fluid communication with fluid supply cavity 58 for supplying water thereto, and a fluid discharge line 66 is in fluid communication with fluid outlet chamber 60 for removing water therefrom. Additionally, a plurality of ice forming cavities, one of which is indicated at 70, are spaced and project upwardly within fluid supply cavity 58 from cavity floor 57. Ice tray 54 may also include mounting means such as opposing side arms 67 and 68, as will be detailed more fully below. As referenced above, the most preferred form of the invention has ice tray 54 mounted in fresh food compartment 8 of refrigerator 2. Although shown as an integral unit, it should be understood that ice tray 54 could be constructed from interconnecting parts.

An evaporator plate 74 located above ice tray 54 includes an evaporator 76 through which refrigerant flows during an ice making event as will be discussed in more detail below. Evaporator 76 is in communication with a plurality of ice forming members 78 extending from evaporator plate 74. Each ice forming member 78 is adapted to extend into a respective one of the ice forming cavities 70. In a manner known in the art, a compressor (not shown) establishes a flow of compressed refrigerant which is condensed via flowing through a condenser (not shown) and then through an expansion device (not shown) and subsequently directed into evaporator 76. Evaporator 76 is cooled by the expanding of the compressed refrigerant and, in turn, ice forming members 78 are also cooled. In accordance with the present invention, ice forming members 78 may be chilled through direct contact with refrigerant, such as by having hollow portions (not shown) of ice forming members 78 being in direct fluid communication with evaporator 76, or ice forming members 78 may be chilled through indirect contact with refrigerant flowing through evaporator 76, i.e., via conduction as shown in FIG. 2. After passing through evaporator 76, the now gaseous flow of refrigerant re-enters the compressor to start the cycle anew. Such refrigerant circulation systems are known in the art and need not be discussed in detail. See, for example, U.S. Pat. Nos. 6,742,351 and 5,127,236 which are incorporated herein by reference.

Figure 3:
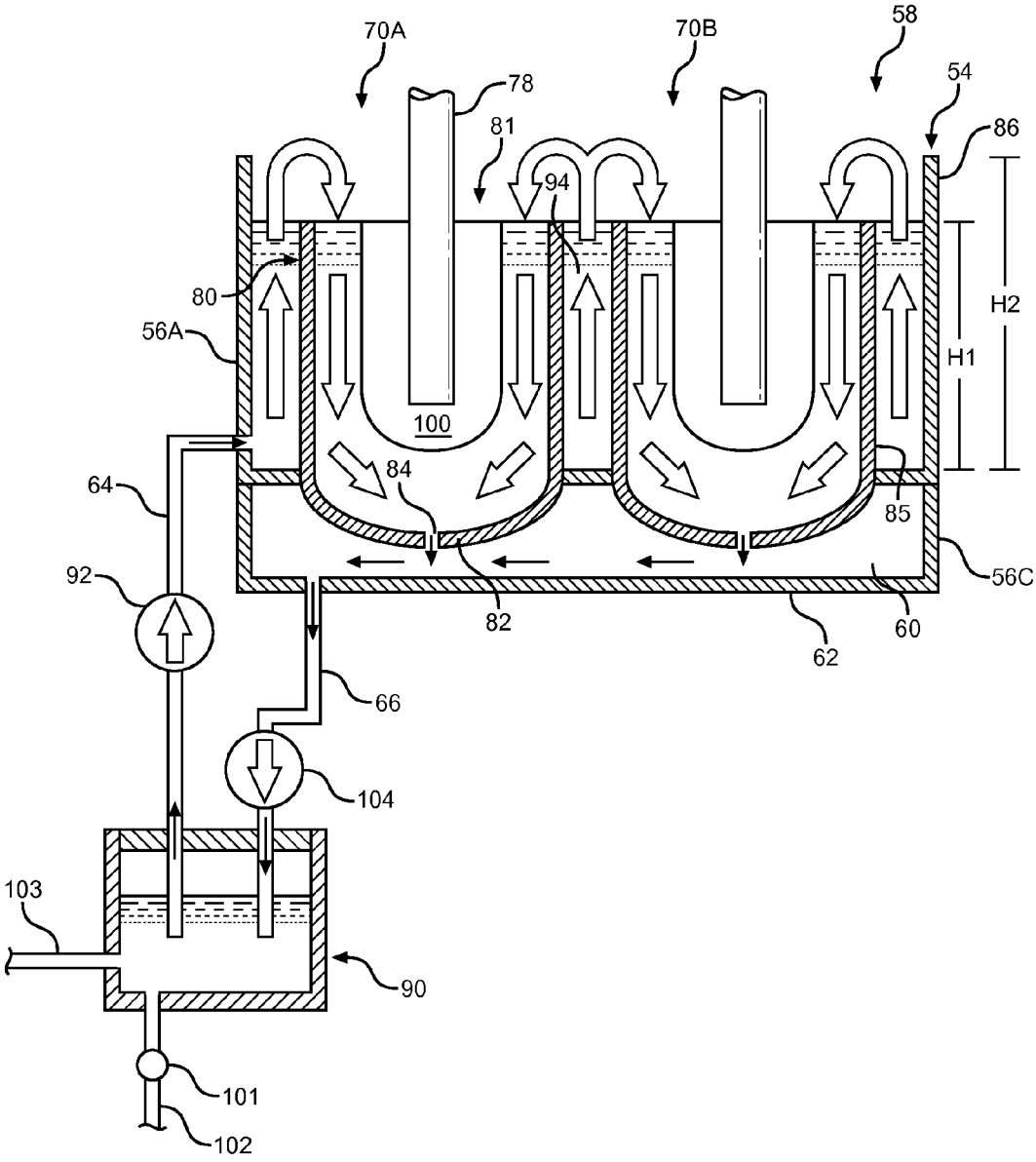
FIG. 3 is an illustration of fluid circulating through an icemaker system of the present invention.

Details of ice forming cavities 70 and the manner in which fluid is circulated through icemaker system 50 will now be discussed with reference to FIG. 3. Although depicted as including two rows of ice forming cavities in FIG. 3, it should be understood that the present invention need not be bound by any particular number of ice forming cavities 70. With reference to FIG. 3, the ice forming cavities shown 70A and 70B are essentially identical, such that only detailed reference will be made to ice forming cavity 70A. At least one side wall 80 defines ice forming cavity 70A which is adapted to hold fluid, and an upper opening 81 of the ice forming cavity 70A. In the preferred embodiment shown, a bottom portion 82 of ice forming cavity 70A extends partially through cavity floor 57 of fluid supply cavity 58 and includes a fluid outlet 84 therein in fluid communication with fluid outlet chamber 60. A height H1 of a portion 85 of side wall 80 extending within fluid supply cavity 58 is lower than a height H2 of a portion 86 of each of side walls 56A-56D extending within fluid supply cavity 58. With this configuration, fluid within fluid supply cavity 58 cascades into each of the ice forming cavities 70, as will be discussed in more detail below.

Various methods of initiating an ice making cycle are known in the art, including providing a controller for initiating an ice making cycle based on the amount of ice stored within an ice bucket. In accordance with the present invention, a known method of initiating an ice making cycle may be utilized, and such details are not considered to be part of the present invention. Instead, the invention is particularly directed to the structure of ice making system 50 and the manner in which ice pieces 100 are produced and dispensed. During an ice making event, fluid is circulated between ice tray 54 of icemaker 52 and a fluid storage cavity indicated at 90 through one or more pumps 92. More specifically, pump 92 continuously supplies fluid from fluid storage cavity 90 to fluid supply cavity 58 through fluid supply line 64. In a preferred embodiment, fluid freely circulates throughout fluid supply cavity 58 through interconnecting fluid channels, indicated at 94, between each of ice forming cavities 70. Fluid rises within fluid supply cavity 58 until the level of fluid surpasses the height H1 of side walls 80 and overflows into each of the ice forming cavities 70. With reference to ice forming cavity 70A, it can be seen that fluid flows around ice forming member 78 and out through fluid outlet 84 to fluid outlet chamber 60. From fluid outlet chamber 60, fluid is recirculated to fluid storage cavity 90 through fluid discharge line 66. With this configuration, fluid constantly flows into ice forming cavity 70A, around the cooled ice forming member 78 therein, and freezes on the surface of ice forming member 78, layer-by-layer over a period of time, to form a clear ice piece indicated at 100. In accordance with the invention, the constant flow of fluid over the forming ice and the layer-by-layer formation "cleans" the ice and enables the formation of clear ice pieces 100 without air bubbles or cloudiness.

In a preferred embodiment, fluid within ice making system 50 is periodically refreshed. More specifically, after a predetermined number of ice making cycles, a drain valve 101 is opened and fluid within fluid storage cavity 90 is drained through a drain line 102 to a refrigerator condensate pan or drain (not shown), and fresh fluid is supplied to the ice making system 50 via a fluid inlet 103. In the embodiment shown, fluid inlet 103 is in communication with fluid storage cavity 90, however, it should be understood that fluid inlet 103 could initially introduce water to ice making system 50 through ice tray 54. After a pre-determined amount of time, or based on another known method for determining the end of an ice production cycle, pump 92 is deactivated and fluid within ice tray 54 is drained into fluid storage cavity 90, either passively based on gravity or through the use of a pump 104.

Figure 4:
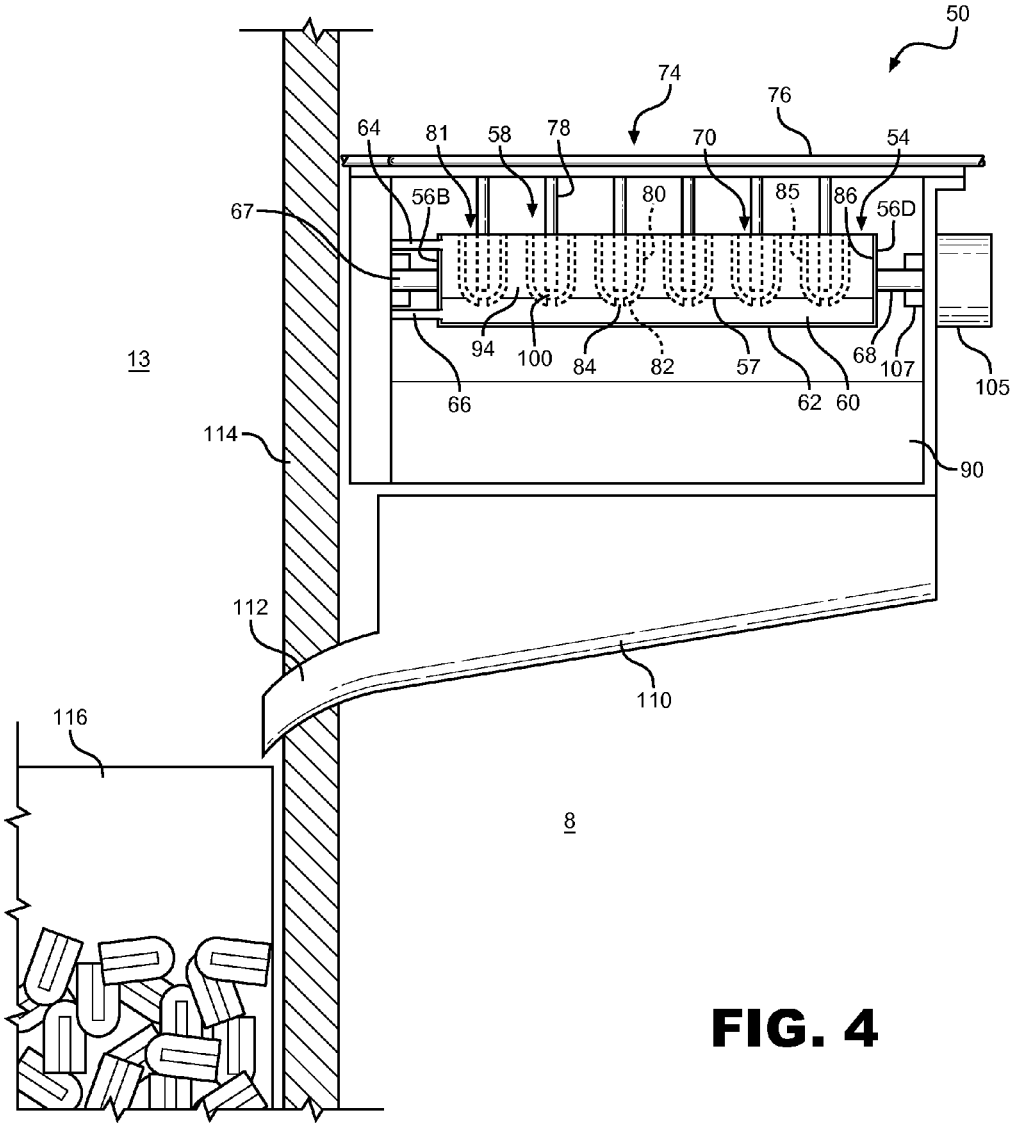
FIG. 4 is a partial cross-sectional front view of a mounted icemaker system of the present invention.

During an ice dispensing cycle, a known ice-tray shifting method is utilized to shift ice tray 54 away from ice forming members 78 in order to release clear ice pieces formed thereon into a storage container or bin below. For example, as depicted in FIG. 4, an actuator 105, such as an electric motor may be utilized to release side arm 68 from a retaining member 107, whereby ice tray 54 swings from a substantially horizontal position to a substantially vertical position through a hinged side arm 67. One example of this type of system can be seen in U.S. Pat. No. 6,742,351, previously incorporated by reference. See, also U.S. Patent Application Publication No. 2009/0211266, teaching a system wherein ice forming fingers are rotated out of an ice tray. In general, various methods for tilting or otherwise swinging an ice tray or evaporator to an ice harvesting position are known in the art, and the present invention is not limited to a particular type of actuator.

Upon initiation of an ice harvesting cycle, ice forming members 78 are heated to melt a portion of the formed ice pieces 100 in contact with ice forming members 78 and release the ice pieces 100 from ice forming members 78. With reference to FIG. 4, in a preferred embodiment, ice pieces released from ice forming member 78 fall into an ice transfer chute 110 located below ice tray 54. In a manner known in the art, heating of ice forming members 78 may be accomplished through the use of a heating element (not shown), such as an electric resistive heating element in heating relationship with ice forming members 78, or through the use of heated refrigerant which is circulated through evaporator 76. In a preferred embodiment, heated refrigerant gas within the refrigerator cooling system is shunted around the condenser and allowed to flow directly through evaporator 76 to heat ice forming members 78 during an ice harvesting procedure. Such harvesting methods are known in the art and, therefore, will not be discussed in detail herein. See, for example, U.S. Pat. No. 5,212,957 and U.S. Pat. No. 7,587,905 incorporated herein by reference.

In a preferred embodiment depicted in FIG. 4, ice released from ice forming members 78 will be deflected by ice transfer chute 110, where the ice pieces will be guided through an aperture 112 located in an insulated wall 114 separating the fresh food and freezer compartments 8 and 13 and into an ice storage bucket 116 located in the freezer compartment 13. With this configuration, the temperature of fresh food compartment 8 will prevent water which does not contact ice making members 78 from freezing within ice making system 50, but clear ice pieces 100 formed by ice making system 50 will be automatically transferred to freezer compartment 13 for storage. Ice bucket 116 is preferably in fluid connection with dispenser 14 for enabling the supply of clear ice through freezer door 12.

Although described with reference to preferred embodiments of the invention, it should be readily understood that various changes and/or modifications can be made to the invention without departing from the spirit thereof. For instance, although depicted in connection with a moving ice tray, it should be understood that the evaporator plate could be configured to move instead of the ice tray during an ice harvesting event. In addition, although the storage cavity is depicted as located directly beneath the ice tray, it should be understood that the storage cavity could be located remote from the ice tray. Furthermore, although each fluid supply cavity is shown to include a single upper opening for receiving both a respective ice forming finger and a flow of water, separate openings could be provided, such as slots in the side wall to establish the desired water flow. In general, the invention is only intended to be limited by the scope of the following claims.

What is claimed is:

1. A refrigerator comprising:

a cabinet including a fresh food compartment and a freezer compartment; and a clear ice making system comprising:

an ice tray including a plurality of side walls and a cavity floor defining a fluid supply cavity, a fluid supply line in fluid communication with the fluid supply cavity, a fluid outlet chamber including a fluid discharge line positioned below the fluid supply cavity, and a plurality of ice forming cavities each defined by at least one side wall extending into the fluid supply cavity from the cavity floor, wherein each of the ice forming cavities is in fluid communication with the fluid supply cavity through a respective upper opening and is in fluid communication with the fluid outlet chamber through an aperture in a bottom portion of the at least one side wall; and an evaporator plate including an evaporator and a plurality of ice forming fingers extending therefrom, wherein the plurality of ice forming fingers are adapted to extend into a respective one of the plurality of ice forming cavities and freeze water thereon to make pieces of ice.

2. The refrigerator of claim 1, wherein the clear ice making system further comprises:

a fluid storage cavity in fluid communication with the ice tray through the fluid supply line and the fluid discharge line; and at least one pump controlling the transfer of fluid between the fluid storage cavity and the ice tray.

3. The refrigerator of claim 2, wherein the clear ice making system further comprises a drain line adapted to drain fluid from the fluid storage cavity.

4. The refrigerator of claim 3, wherein the clear ice making system further comprises a fluid supply line adapted to provide fluid to the fluid storage cavity.

5. The refrigerator of claim 1, wherein the bottom portion of the at least one side wall extends into the fluid outlet chamber.

6. The refrigerator of claim 1, wherein the clear ice making system further comprises a plurality of arms extending from the ice tray for movably mounting the ice tray in the fresh food compartment.

7. The refrigerator of claim 1, wherein the clear ice making system further comprises:

an ice storage bucket located in the freezer compartment; and an ice transfer chute located beneath the ice tray, wherein the ice tray and the evaporator plate are located in the fresh food compartment, and the ice transfer chute is adapted to transfer ice dispensed from the clear ice making system from the fresh food compartment to the freezer compartment.

8. A clear ice making system comprising:

an ice tray including a plurality of side walls and a cavity floor defining a fluid supply cavity, a fluid supply line in fluid communication with the fluid supply cavity, a fluid outlet chamber including a fluid discharge line positioned below the fluid supply cavity, and a plurality of ice forming cavities each defined by at least one side wall extending into the fluid supply cavity from the cavity floor, wherein each of the ice forming cavities is separate from but in fluid communication with the fluid supply cavity through an upper opening and is in fluid communication with the fluid outlet chamber through an aperture in a bottom portion of the at least one side wall; and an evaporator plate including an evaporator and a plurality of ice forming fingers extending therefrom, wherein the plurality of ice forming fingers are adapted to extend into a respective one of the plurality of ice forming cavities.

9. The clear ice making system of claim 8, further comprising:

a fluid storage cavity in fluid communication with the ice tray through the fluid supply line and the fluid discharge line; and at least one pump controlling the transfer of fluid between the fluid storage cavity and the ice tray.

10. The clear ice making system of claim 9, further comprising: a drain line adapted to drain fluid from the fluid storage cavity.

11. The clear ice making system of claim 9, further comprising: a fluid supply line adapted to provide fluid to the fluid storage cavity.

12. The clear ice making system of claim 8, wherein the bottom portion of the at least one side wall extends into the fluid outlet chamber.

13. The clear ice making system of claim 8, further comprising: a plurality of mounting arms extending from the ice tray.

14. The clear ice making system of claim 8, further comprising: an ice transfer chute located beneath the ice tray and adapted to transfer ice dispensed from the clear ice making system to an ice storage bin.

15. A method of producing clear ice utilizing an ice making system including: an ice tray including a plurality of side walls and a cavity floor defining a fluid supply cavity, a fluid supply line in fluid communication with the fluid supply cavity, a fluid outlet chamber including a fluid discharge line positioned below the fluid supply cavity, and a plurality of ice forming cavities each defined by at least one side wall extending into the fluid supply cavity from the cavity floor, wherein each of the ice forming cavities is in fluid communication with the fluid supply cavity through an upper opening and is in fluid communication with the fluid outlet chamber through an aperture in a bottom portion of the at least one side wall; and an evaporator plate including an evaporator and a plurality of ice forming fingers extending therefrom, the method comprising:

an ice making cycle including the steps of:

supplying fluid to the fluid supply cavity through the fluid supply line such that fluid flows from the fluid supply cavity, over the at least one side wall and into each of the plurality of ice forming cavities through a respective upper opening;

continuously circulating fluid from the fluid supply cavity, into the plurality of ice forming cavities and through the aperture in the bottom portion of each of the plurality of ice forming cavities to the fluid outlet chamber;

inserting the plurality of ice forming fingers into a respective one of the ice forming cavities; and cooling the plurality of ice forming fingers such that clear ice pieces form on the plurality of ice forming fingers over a period of time.

16. The method of claim 15, wherein the ice making cycle further comprises:

draining fluid from the fluid outlet chamber to a fluid storage cavity, wherein the step of supplying fluid to the fluid supply cavity includes pumping fluid from the fluid storage cavity through the fluid supply line to the fluid supply cavity.

17. The method of claim 16, further comprising: draining fluid from the fluid storage cavity.

18. The method of claim 15, further comprising: initiating an ice harvesting cycle including the steps of:

heating each of the plurality of ice forming fingers to partially melt the clear ice pieces formed on the plurality of ice forming fingers and releasing the clear ice pieces from the plurality of ice forming fingers.

19. The method of claim 18, wherein the ice harvesting cycle further includes the step of:

transferring the clear ice pieces released from the plurality of ice forming fingers to an ice storage bucket through an ice transfer chute.

20. The method of claim 19, wherein the ice tray is located within a fresh food compartment of a refrigerator and the ice storage bucket is located in a freezer compartment of the refrigerator, and the ice transfer chute transfers the clear ice pieces released from the plurality of ice forming fingers through a wall separating the fresh food and freezer compartments to the ice storage bucket.

* * * * *